United States Patent [19]

Kuwamoto et al.

[11] Patent Number: 4,664,823

[45] Date of Patent: May 12, 1987

[54] METAL-WORKING OIL COMPOSITION

[75] Inventors: Hiroshi Kuwamoto, Fukuyama; Hiroyuki Nagamori; Takashi Mukai, both of Wakayama; Shuichi Iwado, Fukuyama, all of Japan

[73] Assignees: Kao Corporation; Nippon Kokan Kabushiki Kaisha, both of Tokyo, Japan

[21] Appl. No.: 746,008

[22] Filed: Jun. 19, 1985

Related U.S. Application Data

[63] Continuation of Ser. No. 614,559, May 29, 1984, abandoned.

[30] Foreign Application Priority Data

Oct. 6, 1983 [JP] Japan ..... 58-103626

[51] Int. Cl.[4] ..... C01M 3/04; C01M 1/12

[52] U.S. Cl. ..... 252/34; 252/47.5; 252/49.5

[58] Field of Search ..... 252/34, 47.5, 51.5 A, 252/49.5

[56] References Cited

U.S. PATENT DOCUMENTS

| | | | |
|---|---|---|---|
| 3,116,250 | 12/1963 | Krukziener | 252/51.5 A |
| 3,345,319 | 10/1967 | Colgan | 252/51.5 A |
| 3,425,942 | 2/1969 | Coleman | 252/51.5 A |
| 3,455,889 | 7/1969 | Coleman | 252/51.5 A |
| 3,503,946 | 3/1970 | Scanley | 252/51.5 A |
| 3,856,689 | 12/1974 | Hoke | 252/51.5 A |
| 4,194,985 | 3/1980 | Coleman | 252/51.5 A |
| 4,329,249 | 5/1982 | Forsherg | 252/34.7 |
| 4,411,804 | 10/1983 | DeVries | 252/51.5 A |
| 4,469,611 | 9/1984 | Snyder | 252/49.5 |

*Primary Examiner*—John F. Niebling

*Attorney, Agent, or Firm*—Oblon, Fisher, Spivak, McClelland & Maier

[57] ABSTRACT

A metal-working oil composition comprises as essential components thereof (a) one or more lube-oil components selected from the group consisting of oils, fats, mineral oils and fatty acid esters; and (b) one or more water-soluble polymer compounds selected from the group consisting of homopolymers of acrylic amide, copolymers of acrylic amide and other monomers and salts of the homopolymers and copolymers, the molecular weights of which homopolymers, copolymers and salts fall within the range of from 1,000 to 10,000,000.

The incorporation of the specific water-soluble compound allows a lube-oil component to disperse stably as large droplets in water and hence, several advantages including thick and strong lubricating film suitable for use under severe machining conditions can be obtained.

15 Claims, No Drawings

METAL-WORKING OIL COMPOSITION

This appliction is a continution of application Ser. No. 614,559, filed May 29, 1984 now abandoned.

BACKGROUND OF THE INVENTION (i) Field of the Invention

This invention relates to a novel metal-working oil composition, and more specifically to a metal-working oil composition which contains a lube-oil component and a polymer compound of a homopolymer of acrylic amide or a copolymer of acrylic amide and another monomer or a salt of the polymer compound.

(ii) Description of the Prior Art

Conventional metal-working oils which have generally been used are each obtained by adding lube-oil additives such as an oiliness agent, extreme-pressure additive, rust preventive and/or antioxidant to a lube-oil component such as an oil, fat, mineral oil or fatty acid ester and then converting the resultant mixture into an o/w-type emulsion by means of an emulsifier. They are fed to metal-working parts, usually with concentrations of 1 to 20%. In the case of rolling a metal for example, it has been attempted to increase the rolling speed so as to achieve mass production, relying upon rapid advancement in rolling facilities and technology which has been achieved in recent years. Reflecting such an attempt, requirements for rolling oil such as circulation stability of lube-oil, working efficiency and treatment readiness of waste water have become progressively severer. There is thus a strong standing desire for the development of a rolling oil which can satisfactorily meet such requirements. However, conventional rolling oils which make use of emulsifiers are accompanied by various drawbacks and are hence unable to fulfill such requirements. In the case of a conventional rolling oil relying upon an emulsifier, the rolling lubricity was controlled by changing the type and amount of the emulsifier in such a way that the amount of the oil which was to adhere on rolls and each coil surfaces, in other words, the plate-out quantity was either increased or decreased. In such an emulsifier-containing rolling oil as described above, its plate-out quantity and the stability of emulsion however show mutually-contradictory tendency. Namely, the plate-out quantity on rolls and coil surfaces is decreased and the lubricity is thus rendered insufficient if the stability of the emulsion is enhanced. If one tries to increase the plate-out quantity, the emulsion becomes unstable and develops various problems when re-circulated. Accordingly, conventional rolling oils making use of emulsifiers and accompanied by such drawbacks as mentioned above. Furthermore, still further improvements are also desired to the lubricity and working efficiency of other metal-working oils such as press-working oils and cutting oils.

The present inventors therefore carried out a research with a view toward solving the aforementioned drawbacks which conventional emulsion-type metal-working oils had. As a result, it was succeeded to improve the above-described drawbacks by using a lube-oil component, which contained an oil, fat or wax having a melting point of 20° to 100° C., in combination with a specific hydrophilic dispersant (a water-soluble, anionic, polymer compound) in such a way that the lube-oil component was stably suspended and dispersed in a solid form in water at a temperature below the melting point but the resultant dispersion became unstable when fed to each working part, i.e., at a temperature above the melting point. A patent application has been already made on the above finding (see, Japanese Patent Application Laid-open No. 147593/1980).

SUMMARY OF THE INVENTION

The present inventors have further researched the metal-working oil field with the result of a finding of a metal-working oil composition which may be successfully employed for working metals under high shear conditions which are expected to encounter upon an actual application of the oil composition and under high-speed and high-pressure conditions which permit high working speeds and great rolling reductions, permits metal machining under severe cutting conditions, and facilitates such process control as liquid circulation stability.

More specifically, the present inventors have found that (1) use of a specific water-soluble polymer compound permits, owing to the protective colloidal function of the polymer compound, to disperse a lube-oil component stably as large droplets in water and hence, the resulting dispersion enjoys good circulation stability; (2) when supplied to a working part and placed into contact with a metallic workpiece, oil droplets having large diameters form a thick and strong lubricating film over the metallic workpiece; and (3) while re-circulated for an extended period of time, large diameters can be stably maintained against shear forces produced by a stirrer in a tank and by a feed and circulation pump. The present invention has been completed on the basis of the above-described finding.

Accordingly, the present invention provides a metal-working oil composition which comprises as essential components thereof (a) one or more lube-oil components selected from the group consisting of oils, fats, mineral oil and fatty acid esters; and (b) one or more water-soluble polymer compounds selected from the group consisting of homopolymers of acrylic amide, copolymers of acrylic amide and other monomers and salts of the homopolymers and copolymers, the molecular weights of which homopolymers, copolymers and salts fall within the range of from 1,000 to 10,000,000.

DETAILED DESCRIPTION OF THE INVENTION AND PREFERRED EMBODIMENTS

As the lube-oil component which is the component (a) of the metal-rolling oil composition according to this invention, may for example be mentioned a mineral oil such as spindle oil, machine oil, turbine oil or cylinder oil, an animal or vegetable oil or fat such as whale oil, beef tallow, hog fat, rape oil, castor oil, rice bran oil, palm kernel oil or coconut oil, or an ester between a fatty acid obtained from beef tallow, coconut oil, palm oil, castor oil or the like and an aliphatic primary alcohol containing 1 to 22 carbon atoms, ethylene glycol, neopentyl alcohol, penta-erythritol or the like. These components may be used either singly or in combination.

On the other hand, the component (b), namely, the water-soluble polymer compound may be a homopolymer of acrylic amide or a copolymer of acrylic amide and another monomer, and salts and quaternary ammonium salts of the homopolymers and copolymers, the molecular weights of which homopolymers, copolymers, salts and quaternary ammonium salts fall within the range of from 1,000 to 10,000,000. As other monomers capable of undergoing copolymerization with acrylic amide, may be mentioned the following monomers (i)–(xv). One or more of the following monomers or their salt may be copolymerized with acrylic amide.

(i)

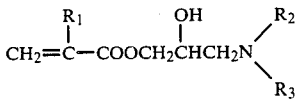

(I)

wherein $R_1$ means H or $CH_3$, and $R_2$ and $R_3$ denote individually H or an alkyl group having 1 to 3 carbon atoms;

(ii)

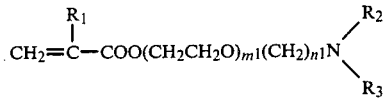

(II)

wherein $m^1$ stands for a number of 1 to 3, $n^1$ is a number of 1 to 3, and $R_1$, $R_2$ and $R_3$ have the same significance as defined in Formula (I);

(iii)

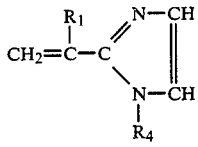

(III)

wherein $R_4$ means H or an alkyl or alkylol group having 1 to 3 carbon atoms, and $R_1$ has the same significance as defined in Formula (I);

(iv)

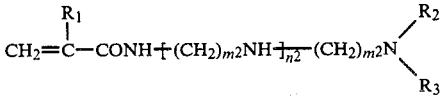

(IV)

wherein $m^2$ and $n^2$ are individually a number of 0 to 3, and $R_1$, $R_2$ and $R_3$ have the same significance as defined in Formula (I);

(v)

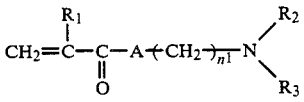

(V)

wherein A means —O— or —NH—, and $R_1$, $R_2$, $R_3$ and $n^1$ have the same significance as defined respectively in Formulae (I) and (II);

(vi)

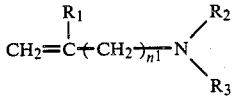

(VI)

wherein $R_1$, $R_2$, $R_3$ and $n^1$ have the same significance as defined respectively in Formulae (I) and (II);

(vii)

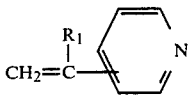

(VII)

wherein $R_1$ has the same significance as defined in Formula (I) and the position of substitution of the pyridine is the 2nd or 4th-position;

(viii)

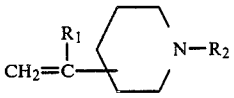

(VIII)

wherein $R_1$ and $R_2$ have the same significance as defined in Formula (I) and the position of substitution of the piperidine is the 2nd- or 4th-position;

(ix)

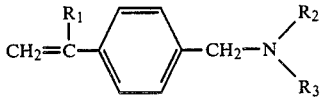

(IX)

wherein $R_1$, $R_2$ and $R_3$ have the same significance as defined in Formula (I);

(x) ethyleneimine:

(xi) $\alpha,\beta$-unsaturated carboxylic acids and their salts and derivatives;

(xii) sulfo-containing vinyl compounds and their salts;

(xiii) acrylonitrile;

(xiv) vinylpyrrolidone; and (xv) aliphatic olefins having 2 to 20 carbon atoms.

As specific examples of these monomers, may be mentioned dimethylaminoethyl acrylate, diethylaminoethyl acrylate, dimethylaminoethyl methacrylate, diethylaminoethyl methacrylate, dimethylaminopropylacrylic amide, diethylaminopropylacrylic amide, dimethylaminopropylmethacrylic amide, diethylaminopropylmethacrylic amide and the like as monomers for Formula (V); dimethylaminomethylethylene, diethylaminomethylethylene, dimethylaminomethylpropene, diethylaminomethylpropene, etc. as monomers of Formula (VI); vinylpyridine and the like as monomers of Formula (VII); vinylpiperidine, vinyl-N-methylpiperidine and the like as monomers of Formula (VIII); vinylbenzylamine, vinyl-N,N-dimethylbenzylamine, etc. as monomers of Formula (IX); and so on. As salts of these polymers, may also be mentioned inorganic acid salts such as the phosphates, phosphites and borates, lower fatty acid salts, lower hydroxy fatty acid salts, organic and acidic phosphoric acid compounds, etc. Among these salts, the phosphates, phosphites, organic and acidic phosphoric acid compounds, and organic and acidic phosphorous acid compounds are preferred from the viewpoint of rust-preventing capacity and the like. Quaternary ammonium salts to be used in this invention can be obtained by either firstly quaternarizing the nitrogen-containing monomers of (i) to (x) by a conventional method and further effect polymerization, or firstly polymerizing the monomers and then quaternarized.

In addition, exemplary monomers of Formulae (XI) to (XV) may embrace pyrrolidone and acrylonitrile;

acrylic acid, methacrylic acid and maleic acid, as well as the alkali metal salts, ammonium salts, amide compounds and ester compounds of these acids; vinylsulfonic acid, methallylsulfonic acid, 2-acrylic amide-2-methylpropanesulfonic acid and p-styrenesulfonic acid, as well as the alkali metal salts and ammonium salts of these acids; and so on.

It is preferred to incorporate such a water-soluble polymer compound in an amount of 0.1 to 20 wt % (hereinafter referred to merely as "%") based on the lube-oil component in the metal-working oil composition of this invention.

To the metal-working oil composition of this invention, it is feasible to add, besides the above-mentioned components, a variety of known additives as needed, for example a rust preventive, oily agents, extreme-pressure additive, antioxidant and the like.

The above-described various additives may, whenever necessary, be added respectively in amounts of 0 to 2%, 0 to 20%, 0 to 3% and 0 to 5%, all based on the total amount of the metal-working oil composition.

As illustrative rust preventives, may be mentioned fatty acids such as alkenylsuccinic acids and their derivatives and oleic acid, esters such as sorbitan monooleate, and amines, and so on. Exemplary oiliness agents may include higher fatty acids such as oleic acid and stearic acid, fatty acid esters which are derivatives of such fatty acids, dibasic acids such as dimeric acid and the like. On the other hand, phosphorus compounds such as tricresylphosphate and organometallic compounds such as zinc dialkyldithiophosphates may be mentioned as examplary extreme-pressure additives. As illustrative antioxidants, may be mentioned phenolic compounds such as 2,4-di-t-butyl-p-cresol, aromatic amines such as phenyl-$\alpha$-naphthylamine, etc.

The metal-working oil composition of this invention may be employed by either mixing the above-described various components or by actually using the metal-working oil composition or preparing it as a thick solution having a water content of up to about 80% in advance and then diluting same with water upon actually using the metal-working oil composition.

The thus-obtained metal-working oil composition according to this invention can provide a rolling oil which can afford relatively large droplets with a stable size distribution under such stirring conditions as having a high shear force, can exhibit high-lubricative rolling ability and shows smaller quality changes along the passage of time. Besides, the above metal-working oil composition of this invention has such merits as will be described next. The water-soluble polymer compound has by itself such capacity as being rapidly adsorbed on a liquid or solid particles to make the liquid or solid particles hydrophilic but does not by itself have any capacity of lowering the interfacial tension between water and oil so as to emulsify their mixture. Therefore, the lube-oil component is not emulsified. Compared with conventional metal-working oils making use of emulsifiers, the metal-working oil composition of this invention is thus advantageous in that it develops the so-called holding-in phenomenon, that is to absorb fouled oil mixed in during an actual rolling operation and foreign matter such as shavings or abatement, only to a lowered extent and it always retain high lubricating characteristics as a clean metal-working oil. Owing to the function of the above-described water-soluble polymer compounds, the metal-working oil composition of this invention has rendered the working environment cleaner and the treatment of waste water easier. Therefore, the metal-working oil composition of this invention has such an excellent feature that it can materialize a clean working environment which has not been achieved by any conventional rolling oils making use of emulsifiers.

Although the mechanism of action of the water-soluble polymer compound which is useful in the practice of this invention has not been fully elucidated, it seems to act probably in the following manner. Namely, the water-soluble polymer compound which has been dissolved completely and uniformly in a water layer adsorbs droplets of the lube-oil component, which droplets have been formed by mechanical shear forces, before the droplets begin to agglomerate. The polymer compound then converts oil droplets into larger droplets in accordance with a sort of coagulation action. The resultant larger droplets are dispersed stably in water by the steric and electric, protective-colloidal action of the polymer compound. This feature is different from that brought about by the water-soluble, anionic, polymer compound in Japanese Patent Application Laid-open No. 147593/1980, because the water-soluble, anionic, polymer compound has a weak coagulation action for oil droplets and the lube-oil component is stabilized still in the form of fine droplets owing to the protective colloidal action and thus-divided fine oil droplets cannot be formed back into larger droplets.

The invention will hereinafter be described with reference to the following Examples.

The following metal-working oil compositions were used in the Examples as well as the following water-soluble polymer compounds, extreme-pressure additive, antioxidant and emulsifier were used.

Water-Soluble Polymer Compounds (A) a homopolymer of acrylic amide ($\overline{MW}=100,000$);

(B) a 1:1 (by molar ratio; all designations of ratios will hereinafter mean molar ratios unless otherwise specified) copolymer of acrylic amide and the phosphoric acid salt of dimethylaminoethyl methacrylate ($\overline{MW}=200,000$);

(B-1) ditto ($\overline{MW}=10,000$);

(B-2) ditto ($\overline{MW}=5,000$);

(B-3) ditto ($\overline{MW}=1,000$);

(C) a 5:3:2 copolymer of acrylic amide, the phosphinic acid salt of dimethylaminoethyl methacrylate and sodium acrylate ($\overline{MW}=100,000$);

(D) the monoethylphosphonic acid salt of a 1:1 copolymer of acrylic amide and ethyleneimine ($\overline{MW}=50,000$);

(E) the boric acid salt of a 2:1:1 copolymer of acrylic amide, ethyleneimine and sodium acrylate ($\overline{MW}=250,000$);

(F) a 1:1:1 copolymer of acrylic amide, the thiophosphoric acid salt of diethylaminoethyl methacrylate and sodium 2-acrylic amide-2-methylpropanesulfonate ($\overline{MW}=50,000$);

(G) a 2:1 copolymer of acrylic amide and the glycollic acid salt of vinylpyridine ($\overline{MW}=100,000$);

(H) a homopolymer of methacrylic amide ($\overline{MW}=20,000$); and (I) a 2:1 copolymer of methacrylic amide and the phosphoric acid salt of ethyleneimine ($\overline{MW}=50,000$).

Antioxidants 2,4-di-t-butyl-p-cresol.

Extreme-Pressure Additive zinc dioctyldithiophosphate.

TABLE 1-1

(%)

| Invention product | Lube-oil component: Beef tallow | Lube-oil component: Fatty acids derived from beef tallow | Water soluble polymer compound | Extreme-pressure additive | Anti-oxidant |
|---|---|---|---|---|---|
| No. 1 | 92 | 2 | (A) 5 | | 1 |
| No. 2 | 96 | 2 | (B) 1 | | 1 |
| No. 3 | 95 | 2 | (B-1) 2 | | 1 |
| No. 4 | 96.9 | 2 | (B-2) 0.1 | | 1 |
| No. 5 | 96.5 | 2 | (B-3) 0.5 | | 1 |
| No. 6 | 92 | 2 | (H) 5 | | 1 |
| No. 7 | 87 | 2 | (C) 10 | | 1 |
| No. 8 | 94 | 2 | (D) 3 | | 1 |
| No. 9 | 76 | 2 | (E) 20 | 1 | 1 |
| No. 10 | 94 | 2 | (F) 1; (G) 1 | 1 | 1 |
| No. 11 | 94.5 | 2 | (A) 0.5; (C) 1 | 1 | 1 |
| No. 12 | 86 | 2 | (F) 10 | 1 | 1 |
| No. 13 | 95.05 | 2 | (G) 0.05 | 1 | 1 |
| No. 14 | 95.05 | 2 | (C) 0.05 | 1 | 1 |
| No. 15 | 95.9 | 2 | (C) 0.1 | 1 | 1 |
| No. 16 | 95 | 2 | (C) 1 | 1 | 1 |

TABLE 1-2

(%)

| Invention product | Lube-oil component: Mineral oil (spindle oil) | Lube-oil component: Octyl stearate | Lube-oil component: Oleic acid | Water-soluble polymer compound | Extreme-pressure additive | Anti-oxidant |
|---|---|---|---|---|---|---|
| No. 17 | 73 | 20 | 5 | (A) 1 | 1 | |
| No. 18 | 73 | 20 | 5 | (B) 1 | 1 | |
| No. 19 | 72 | 20 | 5 | (C) 0.5; (D) 1.5 | 1 | |
| No. 20 | 59 | 20 | 5 | (E) 10; (F) 5 | 1 | |
| No. 21 | 72.8 | 20 | 5 | (G) 0.2 | 1 | 1 |
| No. 22 | 72 | 20 | 5 | (B-2) 1 | 1 | 1 |
| No. 23 | 72 | 20 | 5 | (B-3) 1 | 1 | 1 |
| No. 24 | 72 | 20 | 5 | (I) 1 | 1 | 1 |

TABLE 1-3

(%)

| Invention product | Lube-oil component: Mineral oil (cylinder oil) | Lube-oil component: Pentaerythritol tetraoleate | Water-soluble polymer compound | Extreme-pressure additive | Anti-oxidant |
|---|---|---|---|---|---|
| No. 25 | 78.9 | 20 | (A) 0.1 | 1 | |
| No. 26 | 78 | 20 | (B) 1 | 1 | |
| No. 27 | 69 | 20 | (C) 10 | 1 | |
| No. 28 | 77 | 20 | (D) 1; (E) 1 | 1 | |
| No. 29 | 72 | 20 | (F) 3; (G) 3 | 1 | 1 |
| No. 30 | 77 | 20 | (B-2) 1 | 1 | 1 |
| No. 31 | 77 | 20 | (B-3) 1 | 1 | 1 |
| No. 32 | 77 | 20 | (H) 1 | 1 | 1 |

| | |
|---|---|
| Comparative Product No. 1: | |
| Lube-oil component: | |
| Beef tallow | 94% |
| Fatty acids derived from beef tallow | 2 |
| Extreme-pressure additive | 1 |
| Emulsifier | 2 |
| Antioxidant | 1 |
| Comparative Product No. 2: | |
| Lube-oil component: | |
| Mineral oil (cylinder oil) | 76% |
| Pentaerythritol tetraoleate | 20 |
| Extreme-pressure additive | 1 |
| Emulsifier | 2 |
| Antioxidant | 1 |
| Comparative Product No. 3: | |
| Lube-oil component: | |
| Mineral oil (spindle oil) | 71% |
| Octyl stearate | 20 |

-continued

| | |
|---|---|
| Oleic acid | 5 |
| Extreme-pressure additive | 1 |
| Emulsifier | 2 |
| Antioxidant | 1 |

EXAMPLE 1

Seizure-Resistant Loading Test (Falex Testing Method)

The measurement of seizure-resistant load was carried out in accordance with ASTM Standard D-3233 Pressure Resistant Loading Test (Falex Test). The preparation of each test sample was carried out by diluting each metal-working oil composition with water to a concentration of 3% and then mixing the resultant mixture at 10,000 rpm in a homogenizer. The coating of each test sample was effected by applying the above-mixed solution to a rotary pin, which was disposed centrally in a fixed block, at a spray rate of 50 ml/min.

(a pressure of 0.5 kg/cm$^2$) and a dispersion temperature of 50° C. by means of a gear pump.

Results are given in Table 2.

TABLE 2

| Metal-working oil composition | Seizure-resistant load (lbs.) |
|---|---|
| Invention product No. 1 | 2000 |
| Invention product No. 2 | 1750 |
| Invention product No. 3 | 2000 |
| Invention product No. 4 | 1750 |
| Invention product No. 5 | 1000 |
| Invention product No. 6 | 1750 |
| Invention product No. 7 | 2000 |
| Invention product No. 8 | 2000 |
| Invention product No. 9 | 1750 |
| Invention product No. 10 | 2000 |
| Invention product No. 11 | 2000 |
| Invention product No. 12 | 1500 |
| Invention product No. 13 | 1250 |
| Invention product No. 14 | 2000 |
| Invention product No. 15 | 1750 |
| Invention product No. 16 | 1750 |
| Invention product No. 17 | 1750 |
| Invention product No. 18 | 1750 |
| Invention product No. 19 | 1750 |
| Invention product No. 20 | 1750 |
| Invention product No. 21 | 1750 |
| Invention product No. 22 | 1750 |
| Invention product No. 23 | 2000 |
| Invention product No. 24 | 1500 |
| Invention product No. 25 | 1750 |
| Invention product No. 26 | 1750 |
| Invention product No. 27 | 2000 |
| Invention product No. 28 | 1750 |
| Invention product No. 29 | 1750 |
| Invention product No. 30 | 1750 |
| Invention product No. 31 | 1250 |
| Invention product No. 32 | 1500 |
| Comparative product No. 1 | 1250 |
| Comparative product No. 2 | 1000 |
| Comparative product No. 3 | 1000 |

EXAMPLE 2

Seizure Loading Test (Soda's Four-Balls Testing Method)

The measurement of seizure loads was conducted in accordance with Japanese Self-Defence Force Provisional Standard NDS XXK 2740, Oil Film Strength Testing Method (Soda's Four-Balls Testing Method). The preparation of each test sample was carried out by diluting each metal-working oil composition with water to a concentration of 3% and then mixing the resultant mixture at 10,000 rpm in a homogenizer. The coating of each test sample was effected by applying the above-mixed solution upwardly through a gap formed centrally among three points of contact of three testing steel balls, which were fixed by a ball retainer, to a rotary steel ball, which assumed a position above the three balls, at a spray rate of 0.5 liter/min. (a pressure of 0.5 kg/cm$^2$) and a sample solution temperature of 50° C. by means of a gear pump.

Results are summarized in Table 3.

TABLE 3

| Metal-working oil composition | Seizure load (kg/cm$^2$) |
|---|---|
| Invention product No. 1 | 12.0 |
| Invention product No. 2 | 11.5 |
| Invention product No. 3 | 10.0 |
| Invention product No. 4 | 11.0 |
| Invention product No. 5 | 10.5 |
| Invention product No. 6 | 10.0 |
| Invention product No. 7 | 12.0 |
| Invention product No. 8 | 12.5 |
| Invention product No. 9 | 11.0 |

TABLE 3-continued

| Metal-working oil composition | Seizure load (kg/cm$^2$) |
|---|---|
| Invention product No. 10 | 10.5 |
| Invention product No. 11 | 11.5 |
| Invention product No. 12 | 11.0 |
| Invention product No. 13 | 7.5 |
| Invention product No. 14 | 7.5 |
| Invention product No. 15 | 10.0 |
| Invention product No. 16 | 10.5 |
| Invention product No. 17 | 8.0 |
| Invention product No. 18 | 8.5 |
| Invention product No. 19 | 9.0 |
| Invention product No. 20 | 8.5 |
| Invention product No. 21 | 8.0 |
| Invention product No. 22 | 8.5 |
| Invention product No. 23 | 7.5 |
| Invention product No. 24 | 7.0 |
| Invention product No. 25 | 7.5 |
| Invention product No. 26 | 8.0 |
| Invention product No. 27 | 7.5 |
| Invention product No. 28 | 8.0 |
| Invention product No. 29 | 8.0 |
| Invention product No. 30 | 8.5 |
| Invention product No. 31 | 8.0 |
| Invention product No. 32 | 8.0 |
| Comparative product No. 1 | 7.5 |
| Comparative product No. 2 | 6.0 |
| Comparative product No. 3 | 5.5 |

EXAMPLE 3

Test on Readiness of Treatment of Waste Water

Each test solution (1 liter) prepared in the same manner as in Example 2 was added with 3 g of aluminum sulfate. The resulting mixture was stirred for 2 minutes, following by an addition of $Ca(OH)_2$ to adjust its pH to 7.0. The thus-prepared mixture was stirred for further 10 minutes. After allowing the resultant mixture to stand for 30 minutes, the supernatant was collected to measure its COD (in accordance with the $KMnO_4$ method). Results are given in Table 4.

TABLE 4

| Metal-working oil composition | COD (ppm) |
|---|---|
| Invention product No. 1 | 253 |
| Invention product No. 2 | 315 |
| Invention product No. 3 | 362 |
| Invention product No. 4 | 198 |
| Invention product No. 5 | 211 |
| Invention product No. 6 | 398 |
| Invention product No. 7 | 387 |
| Invention product No. 8 | 222 |
| Invention product No. 9 | 188 |
| Invention product No. 10 | 201 |
| Invention product No. 11 | 425 |
| Invention product No. 12 | 233 |
| Invention product No. 13 | 875 |
| Invention product No. 14 | 661 |
| Invention product No. 15 | 729 |
| Invention product No. 16 | 169 |
| Invention product No. 17 | 253 |
| Invention product No. 18 | 199 |
| Invention product No. 19 | 438 |
| Invention product No. 20 | 249 |
| Invention product No. 21 | 250 |
| Invention product No. 22 | 218 |
| Invention product No. 23 | 365 |
| Invention product No. 24 | 455 |
| Invention product No. 25 | 213 |
| Invention product No. 26 | 209 |
| Invention product No. 27 | 318 |
| Invention product No. 28 | 267 |
| Invention product No. 29 | 338 |
| Invention product No. 30 | 387 |
| Invention product No. 31 | 226 |
| Invention product No. 32 | 387 |
| Comparative product No. 1 | 2640 |
| Comparative product No. 2 | 2760 |

TABLE 4-continued

| Metal-working oil composition | COD (ppm) |
|---|---|
| Comparative product No. 3 | 3200 |

What is claimed is:

1. An aqueous metal-working lubricating composition, consisting essentially of:

a stable dispersion of oil in water of:

(a) at least one lube-oil component selected from the group consisting of animal or vegetable oils or fats, mineral oils and fatty acid esters; and (b) at least one water-soluble polymer compound selected from the group consisting of (1) a homopolymer of (meth)acrylamide, (2) a copolymer of (meth)acrylamide and another monomer, and (3) salts and quaternary ammonium salts of said homopolymer and copolymer, each having a molecular weight of from 1,000 to 10,000,000;

wherein the other monomer is at least one monomer selected from the group consisting of monomers of formula (i) to (x), the salts thereof and monomers represented respectively by the following formulae (xi) to (xv):

(i)

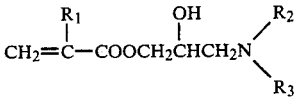

(I)

wherein $R_1$ is H or $CH_3$, and $R_2$ and $R_3$ individually H or an alkyl group having 1 to 3 carbon atoms;

(ii)

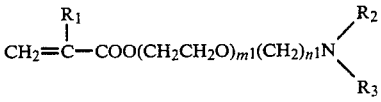

(II)

wherein $m^1$ is 1 to 3, $n^1$ is 1 to 3, and $R_1$, $R_2$ and $R_3$ are as defined in Formula (I);

(iii)

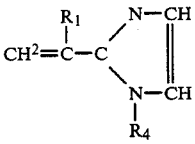

(III)

wherein $R_4$ is H or $C_1$–$C_3$ alkyl or alkylol; and $R_1$ is as defined in Formula (I);

(iv)

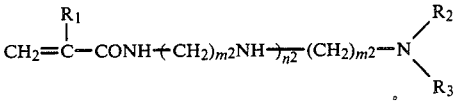

(IV)

wherein $m^2$ and $n^2$ are 0 to 3, and $R_1$, $R_2$ and $R_3$ are as defined in Formula (I):

(v)

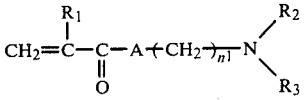

(V)

wherein

A is —O— or —NH—, and $R_1$, $R_2$, $R_3$ and $n^1$ are as defined respectively in Formulas (I) and (II):

(vi)

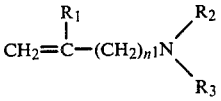

(VI)

wherein $R_1$, $R_2$, $R_3$ and $n^1$ are as defined respectively in Formulas (I) and (II);

(vii)

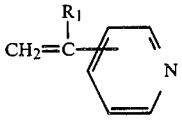

(VII)

wherein $R_1$ is as defined in Formula (I), and the positions of substitution of the pyridine are the 2nd and 4th-positions;

(viii)

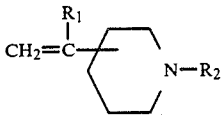

(VIII)

wherein $R_1$ and $R_2$ are as defined in Formula (I), and the positions of substitution of the piperidine are the 2nd- or 4th-positions;

(ix)

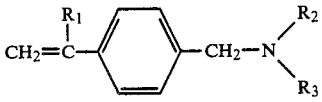

(IX)

wherein $R_1$, $R_2$ and $R_3$ are as defined in Formula (I);

(x) ethyleneimine:

(xi) $\alpha,\beta$-unsaturated carboxylic acids and their salts and derivatives;

(xii) sulfo-containing vinyl compounds and their salts;

(xiii) acrylonitrile, (xiv) vinylpyrrolidone; and (xv) aliphatic olefins having 2 to 20 carbon atoms.

2. The metal-working oil composition of claim 1 wherein the water-soluble polymer compound is contained in an amount of 0.05 to 20 wt. % based on the lube oil component.

3. The metal-working oil composition of claim 1 wherein the monomers of the formula (V) are selected from the group consisting of dimethylaminoethyl acrylate, diethylaminoethyl acrylate, dimethylaminoethyl methacrylate, diethylaminoethyl methacrylate, dimethylaminopropylacrylic amide, diethylaminopropylacrylic amide, dimethylaminopropylmethacrylic amide, and diethylaminopropylmethacrylic amide.

4. The metal-working oil composition of claim 1 wherein the monomers of formula (VI) are selected from the group consisting of dimethylaminomethylethylene, diethylaminomethylethylene, dimethylaminomethylpropane, and diethylaminomethylpropene.

5. The metal-working oil composition of claim 1 wherein the monomers of formula (VII) are vinylpyridine.

6. The metal-working oil composition of claim 1 wherein the monomer of formula (VIII) is selected from the group consisting of vinylpiperidine and vinyl-N-methylpiperidine.

7. The metal-working oil composition of claim 1 wherein the monomers of formula (IX) are selected from the group consisting of vinylbenzylamide and vinyl-N,N-dimethylbenzylamine.

8. The metal-working oil composition of claim 1, wherein the salts of the (b) polymer compound are selected from the group consisting of inorganic acid salts, lower fatty acid salts, lower hydroxy fatty acid salts, organic phosphoric acid compounds, acidic phosphoric acid compounds, phosphorous acid compounds, organic phosphorous acids compounds, the quaternary ammonium salts.

9. The metal-working oil composition of claim 8 wherein the inorganic acid salts are selected from the group consisting of phosphates, phosphites and borates.

10. The metal-working oil composition of claim 1 wherein the monomers of formula (XI) through (XV) are selected from the group consisting of pyrrolidone;
acrylonitrile;
acrylic acid;
methacrylic acid;
maleic acid;
alkali metal salts thereof;
ammonium salts thereof;
amide compounds thereof;
ester compounds thereof;
vinylsulfonic acid;
methallylsulfonic acid; and
2-acrylic amide 2-methylpropanesulfonic acid;
p-stryenesulfonic acid;
alkali metal salts and ammonium salts thereof.

11. The metal-working oil composition of claim 1 further consisting of a component selected from the group consisting of:

additives;
rust-preventing agents;
oily agents;
extreme-pressure additives;
antioxidants; and
mixtures thereof.

12. The metal-working oil composition of claim 11, wherein the rust-preventing agents are selected from the group consisting of fatty acids,
esters thereof, and
amines thereof.

13. The metal-working oil composition of claim 11 wherein the oily agents are selected from the group consisting of higher fatty acids,
fatty acid esters, and
dibasic acids.

14. The metal-working oil composition of claim 11 wherein the extreme-pressure additives are selected from the group consisting of tricresyl phosphate and
organometallic compounds.

15. The metal-working oil composition of claim 11 wherein the antioxidants are selected from the group consisting of phenolic compounds and
aromatic amines.

* * * * *